United States Patent [19]

Reifenhauser et al.

[11] Patent Number: 4,906,228

[45] Date of Patent: Mar. 6, 1990

[54] METHOD AND APPARATUS FOR THE MANUFACTURE OF PLASTIC BAGS IN PAIRS WITH SIDE SEAMS

[75] Inventors: Hans Reifenhauser, Troisdorf; Robert Wagner, Troisdorf-Sieglar, both of Fed. Rep. of Germany

[73] Assignee: Stiegler GmbH Maschinenfabrik, Rudersberg, Fed. Rep. of Germany

[21] Appl. No.: 176,453

[22] Filed: Apr. 1, 1988

[30] Foreign Application Priority Data

Apr. 2, 1987 [DE] Fed. Rep. of Germany ..... 3711165
Nov. 19, 1987 [DE] Fed. Rep. of Germany ... 8715327[U]
Feb. 1, 1988 [DE] Fed. Rep. of Germany ... 8801173[U]

[51] Int. Cl.[4] ..... B31B 23/74; B31B 23/60; B31B 23.26; B31B 23/14

[52] U.S. Cl. ..... 493/196; 493/235; 493/194; 493/195; 493/11; 493/926; 493/29

[58] Field of Search ..... 383/10, 7, 6, 17, 9, 383/13, 17, 22, 26, 27, 78, 84, 86.2, 37; 206/554; 493/194, 195, 196, 231, 235, 243, 260, 245, 248, 11, 29, 926

[56] References Cited

U.S. PATENT DOCUMENTS 4,182,222 1/1980 Stahl ..... 493/196
4,605,392 8/1986 Achelpohl ..... 493/196
4,702,731 10/1987 Lambrecht ..... 493/926
4,704,100 11/1987 Kaufman ..... 493/926

*Primary Examiner*—Frederick R. Schmidt
*Assistant Examiner*—Jack W. Lavinder
*Attorney, Agent, or Firm*—Antonelli, Terry & Wands

[57] ABSTRACT

The invention relates to a process and apparatus for the paired manufacture of carry bags from synthetic resin sheeting with lateral weld seams and an approximately sinusoidal load-bearing rim with punched-in handle openings, wherein a laid-flat tubular film is cut open in wave shape, and the two cut-apart semitubular sheets (1*a*, 1*b*) are pulled apart transversely to the conveying direction, the wave crests are folded over at least in part in parallel to the folding edges (3) in each case either toward the outside or toward the inside, then the semitubular sheets are again united in order to compensate for at least a portion of the gap S produced by folding over the flaps, and after achieving a synchronous run of the folded over flaps (51, 52), the latter are welded to the lower and upper sheet layers (10*a*, 10*b*) of the semitubular sheets (1*a*, 1*b*) in the area (15) surrounding the subsequent handle opening (4), the wave crests, prior to being folded over, being electrically discharged and, after having been folded over, being again charged electrically prior to the provision of the weld bond.

6 Claims, 6 Drawing Sheets

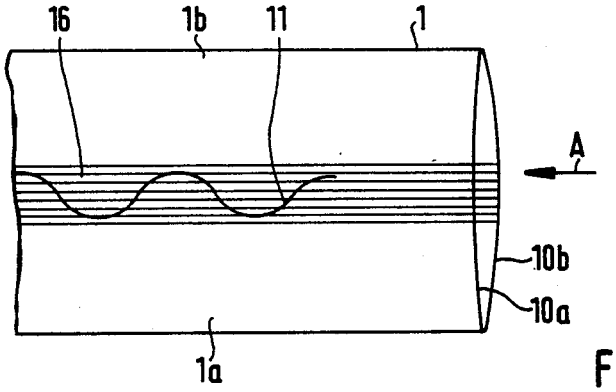
FIG. 3
FIG. 6
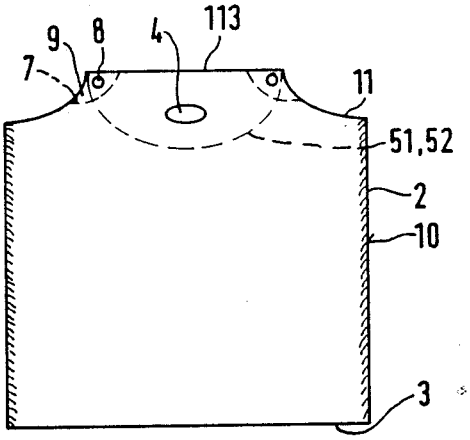
FIG. 7
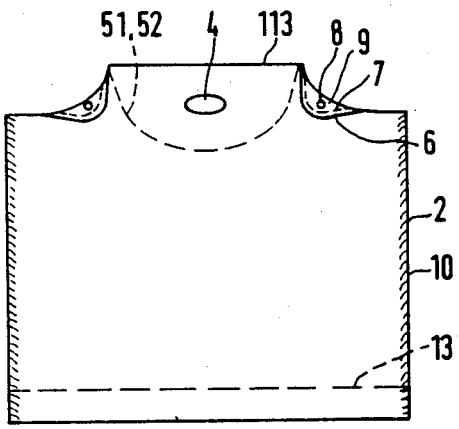

METHOD AND APPARATUS FOR THE MANUFACTURE OF PLASTIC BAGS IN PAIRS WITH SIDE SEAMS

The invention relates to a process for the production of carry bags from synthetic resin sheeting with hot wire welded side seams and an approximately sinusoidal load-bearing rim with punched-in handle openings, wherein a laid-flat tubular film is cut open along its center in a wave shape with wave crests and wave troughs, especially in a sinusoidal form, for the paired manufacture of two bags, and the two cut-open semitubular sheets are pulled apart transversely to the conveying direction and are further conveyed in mutually offset fashion, so that wave crests and wave troughs of the semitubular sheets run in synchronism, handle openings are punched out, and the side seams of juxtaposed bags are produced by hot wire welding transversely to the conveying direction, and the thus-evolving bags are stacked.

The invention furthermore relates to carry bags of synthetic resin sheeting with hot wire welded lateral seams and an approximately sinusoidal load-bearing rim with punched-in handle openings and bottom folding edge, produced by cutting open, in a wave form with wave crests and wave troughs, especially in a sinusoidal shape, a double wide, laid-flat tubular film along the middle thereof.

The invention likewise concerns a machine for the paired manufacture of shopping bags with punched handle opening, a reinforcing sheet surrounding the handle opening, and lateral weld seams, from a laid-flat tubular sheet of synthetic resin film, containing, in the feeding direction in succession, a first, continuously operating take-off device for the tubular sheet equipped with a sheet edge control, a continuously operating cutter for separating the tubular sheet with a wavy-contoured separating cut into two semitubular sheets, a rerouting means for diverging transversely to the feeding direction and partial offsetting of the semitubular sheets with respect to each other in parallel to the feeding direction, a second, intermittently operating take-off device for the stepwise advancing of the semitubular sheets, wherein a compensating device for the sheet feed is provided between the first and second take-off devices, and a punching device for the handle openings, operable periodically during the standstill of the semitubular sheets, a cross cutting and welding device for welding together and separating the carry bags, as well as a conveying means for depositing the carry bags.

It is known, for increasing the load-bearing capacity of shopping bags, to reinforce the areas of the handle openings. Carry bags with side seam, handle hole, and glued-on or welded-on reinforcing leaf, having a sinusoidal load-bearing rim, have been known from U.S. Pat. No. 4,125,220; DOS 3,222,376 (=British Pat. No. 2,121,721) or, interconnected into packs, from DOS 3,424,748 (=U.S. Pat. No. 4,690,280). The use of glue herein is considered a drawback because glue is not only a pollutant but also makes the product more expensive.

A method for the paired manufacture of shopping bags from a tubular film, cut open in a wave form, wherein the wave crests are folded over and welded in place, the handle holes are punched into the folded-over sections, and then the semitubular sheets are pulled apart, is described in German Pat. No. 2,608,734. The performance of the process is impeded by handling along the cutting edge.

German Pat. No. 3,153,147 (=U.S. Pat. No. 4,451,249) discloses a machine for producing respectively two stacks of bags from double-ply thermoplastic sheet material wherein a device for cutting open of the tubular film and/or double bag is provided in conjunction with the stacking means for double bags. Carry bags having a sinusoidal carry edge cannot be produced by using a machine according to German Pat. No. 3,153,147.

The invention is based on the object of proposing a simple and economical method and a machine for the paired manufacture of side-seam bags having an approximately sinusoidal load-bearing rim with welded-in handle hole reinforcement. It is also to be possible to interconnect the bags into packs.

In order to attain this object, the invention teaches, based on a process of this type, that, after the pulling apart of the separated semitubular sheets, the wave crests are folded over at least in part in parallel to the folding edges, in each case either toward the outside or toward the inside, then the semitubular sheets are reunited in order to compensate for at least part of the gap S produced by the folding over of the flaps, and, after attaining a synchronous travel of the folded-over flaps of the semitubular sheets at the same level, the flaps at the upper and lower sheet plies of the semitubular sheets are welded on in the area surrounding the subsequent handle opening; and that the wave crests, prior to being folded over, are electrically discharged and, after having been folded over, are again charged electrically before providing the welding bond.

The process of this invention offers advantages over conventional methods in the realms of product technology as well as process technique. The present process is harmless to the environment, since it operates without adhesives. There is no waste, either. For welding on the flaps, the contact welding method is preferably employed. In one version, a plurality of spot welding areas are applied in the manner of a welding grid; in this procedure, a denser grid of spot welding areas is applied around the handle opening to increase load-bearing capacity and resistance to tearing. The grid-like spot welding enhances tear strength and grip of the load-bearing rim without rendering the latter rigid. Another possibility resides in the formation of bead-like welded areas in the shape of weld beads surrounding the handle opening and being curved in a concave fashion. This pattern-like welding on of the flaps is performed at rest during the intermittent advance of the semitubular sheets.

The carry bags can also be interconnected, wherein the interconnection is effected in the region of one sheet ply or both sheet plies. Interconnecting is provided according to this invention above or on both sides of the handle opening zone.

According to the invention, it is also possible to utilize tubular sheeting with strips of thicker material incorporated by extruding; these strips extend in the two sheet plies in the area of the subsequent load-bearing rim, and the sinusoidal cut extends therein. This permits an especially high strength of the load-bearing rim and/or the handle hole zone since the reinforcement additionally extends over the entire width of the bag.

In the process of this invention, the semitubular sheets are pulled apart sideways at least to some extent in order to provide space in the middle for folding over, punching, welding. According to another embodiment of the invention, the two half tubes obtained by central cutting of the tubular film sheet mutually exchange their conveying routes by being deflected so that the opening cutting edges of the half tubes, previously extending in the middle of the conveying route, are guided along the outsides of the conveying route, and the marginal folds are folded over from the outsides in the outward or inward direction.

Thus, adequate space is present along the outsides for manipulation. After the deflection and/or pulling apart of the semitubular sheets, the latter are aligned by means of a control unit scanning the inner edges or outer edges so that the wave crests and wave troughs are further conveyed synchronously at the same level. Adjustable rolls can be employed as the positioning means. The edge control makes it possible for the semitubular sheets to properly enter the subsequent devices for welding the flaps in place and for punching the handle openings. The two guide devices for the two semitubular sheets are designed according to the invention so that they can be positioned independently of each other; consequently, they also contribute toward accurate positional control of the bags to be separated later on.

According to the invention, the wave crests can be turned over entirely or also merely partially. The sinus cut can be executed with differing amplitude and wavelength. In case of minor amplitudes of the wave crests with a height H of up to about 80–90 mm, approximately the entire wave crest should be folded over. In case of wave crests having a height H of about 80or 90–180 mm, the partial folding over of the wave crests is sufficient for forming the reinforcement for the handle opening.

In order to make it possible for the bags to be interlocked, a further suggestion of the invention provides that the flaps of one sheet ply of the half tubes, especially the lower one, is designed narrower, i.e. with a smaller height than the flaps of the other sheet ply so that a marginal strip is created at one sheet ply which projects with respect to the other sheet ply and can be utilized for interlocking the bags into a pack. The interconnecting section, i.e. the protruding marginal strip, is equipped with a perforation along the folding edge of the other sheet ply; the bag can be torn off the interlocked pack along this perforation. The tear-off perforation can be punched prior to or after the hot wire welding step. For bags which are to receive two lateral interconnecting sections, it is proposed that sections especially provided with an arcuate cutting edge be punched out of the upper sheet ply as the counterparts to be cut out for respectively two interconnecting sections arranged on both sides of the handle opening zone. This punching step can be performed before or after punching the handle holes. Suspension holes are punched into the interconnecting section. The lateral interconnecting sections are preferably located within the width of the bag rather than directly adjoining the side seams. In this way, the object is achieved that the bags, in the interlocked and hanging condition, can be opened with adequate ease for sufficient filling of the bags.

It is likewise possible to obtain an interlocking section by separating a marginal strip or section at the folded-over flap edge of a sheet ply. In this arrangement, the separating cut for the marginal strip should be carried out by means of a heated punching blade so that the cutting edges of the flap will adhere or be welded to the sheet ply.

It is possible by means of the process of this invention to produce shopping bags having a side seam and a handle hole with handle holes having a sinusoidal carry edge of varying height (amplitude) and reinforced by outwardly or inwardly folded-over and at least partially welded-on flaps.

An advantageous embodiment of a carry bag of the type discussed above according to this invention is characterized in that flaps are formed in the zone of the sinusoidal cutting edges by folding over at least a portion of the wave crests outwardly or inwardly in parallel to the bottom folding edge, and the flaps are welded to the front and rear walls of the bag by way of at least one welded zone in the shape of a bead having a concave curvature with respect to the handle hole and surrounding at least the lateral lower corners of the handle hole.

The shopping bag of this invention exhibits high load-bearing capacity; it is inexpensive in its manufacture without creating waste, and has a large filling aperture.

Interconnected packs of shopping bags are obtained according to this invention by fashioning the bags in such a way that one of the flaps is made to be narrower than the other so that one wall of the bag protrudes with its flap partially beyond the other wall, thereby forming a marginal strip usable as the interconnecting section. A further possibility for interconnecting the carry bags can be obtained by fashioning interconnecting sections in accordance with the fatures of claim 9.

By means of the design of the welded zones of the flap with the walls of the bag, in accordance with this invention, it is made possible to concentrate and restrict the welded areas to the locations contributing toward increasing the strength and tear resistance of the handle hole and thus toward raising the load-bearing capacity of the carry bag.

In practice, welding dies and welding bars having the shape of the slightly concavely curved beads can be produced in a simple way. The width of the weld beads can be kept at a relatively small size, lying preferably between about 2 and 4 mm. The width is also dependent on the thickness of the sheets to be welded together. The length and number of the weld beads depend on the size of the shopping bag and on the shape of the handle hole. In case of small carry bags with folded-over flap, for example, a weld bead surrounding the handle hole on the underside in a crescent shape may already be sufficient, or two small weld beads having a slightly arcuate shape and being arranged below or, respectively, laterally of the lower handle hole corners and in symmetry to the longitudinal axis of the shopping bag may already be adequate. In case of larger shopping bags, the flaps can be welded to the sheet layers with four weld beads located at the four outer corners of the handle hole and surrounding the latter in crescent shape.

The carry bags are made of weldable thermoplastic synthetic resins, customarily on the basis of polyolefins. The sheets can be single-ply or multiple-ply.

Based on a machine of this type, the invention proposes an improved arrangement by means of which shopping bags of this kind and according to this invention can be economically manufactured. The machine in accordance with this invention is distinguished in that, following the rerouting device, a folding device is provided with rerouting fingers and deflector plates arranged in pairs on both sides of the longitudinal axis of the machine, for folding over the mutually opposed wave crests of the upper and lower sheet plies of the semitubular sheets toward the inside or outside with continuous sheet feed, and, in parallel to the folding over device, at the outer edges of the semitubular sheets, respectively one supporting device is located; that directly upstream of the folding device an electrical discharge unit is arranged, and directly downstream of the folding device, an electrical charging device is arranged; that, downstream of the compensating unit following the folding device, a control device is provided with a scanning head and a correcting roll for each semitubular sheet, which device scans the inner or outer edges, for the positionally accurate placing of the semitubular sheets with respect to the subsequently located, intermittently operable processing stations; and that, upstream of the punching means, a contact welding unit is provided with a pedestal in the longitudinal axis of the machine with a backup plate guided between the sheet layers and with liftable and lowerable welding plates acting from the outside from the top and bottom on the sheet layers.

Slipping of the sheets during folding over of the wave crests is avoided by supporting the semitubular sheets on the outer edges during the folding over step. The supporting means can preferably be fashioned as a device for producing the bottom pleats. If carry bags without bottom pleats are to be manufactured, then only a simple support is to be provided.

The positionally accurate folding over of the wave crests is furthermore facilitated by electrostatic discharging—neutralizing—the sheet at the beginning of the folding step in the folding device. The sheet plies, positively charged electrostatically, repel each other; on account of the neutralization, the sheet plies lie down more readily during the folding over step and are then again charged electrostatically after folding is completed so that they now adhere and can be welded in place in this position. An advantageous embodiment of the discharging and charging means provides that the discharging device is constituted by two elongated rods arranged in parallel to the feeding direction A between the two sheet plies of each half tube, and the charging device is a rod acting from the outside transversely to the feeding direction A on the semitubular sheets, the inactive zones of this rod being shielded. An advantageous and compact design of the machine is achieved by locating the folding device in a zone wherein the semitubular sheets are guided along a pedestal vertically from the top toward the bottom.

For folding over the individual wave crests of the semitubular sheets, it is not necessary for the wave crests to be guided already at this point at the same level. To facilitate folding over of the wave crests and engagement of the rerouting fingers and provision of the deflector plates, the semitubular sheets, prior to being introduced into the folding device, are pulled apart after cutting in the preceding first rerouting device, in order to create a free space in the middle. By folding the wave crests over away from the middle, a correspondingly large gap is formed between the two semitubular sheets. The provision is made, according to the invention, to reduce this gap again to a minimum in order to facilitate the subsequent paired processing of the shopping bags, such as welding on of the flaps, punching of the handle holes with a device located in the center of the conveying route. If the semitubular sheets are pulled apart as early as in the first rerouting device to such a degree that the wave crests run side-by-side at the same level, then a very large gap is produced during the subsequent folding over of the flaps. For this reason, it is advantageous to pull the semitubular sheets apart in the first rerouting device merely to a partial extent and displace them with respect to each other only partially. According to the invention, it is suggested that then, between the folding device and the compensating device for intermittent sheet feed, a further rerouting device be arranged for uniting the semitubular sheets transversely to the feeding direction A and/or displacing of the semitubular sheets in the feeding direction A with respect to each other. By means of this device, it is possible, on the one hand, to again reduce the free space, created by folding over of the wave crests, to the desired dimension. At the same time, it is possible by means of this device to shift the semitubular sheets additionally mutually in the feeding direction to such an extent—unless this has already been done previously at least in part—that the wave crests of the semitubular sheets are continuing on their way in synchronism at the same level.

In order to attain exact positioning of the folded-over wave crests for welding on the flaps, punching the handle holes, especially correlating the welding surfaces with the handle holes, the provision is made according to the invention that the position of the semitubular sheets, after folding over of the wave crests and downstream of the second rerouting device, is detected and regulated by scanning the contour of the inner edges or outer edges by means of a control unit with the use of a scanning head. For controlling the position of the semitubular sheets, liftable and lowerable correcting rolls are provided, for example, the semitubular sheets being individually guided thereover. The load-bearing capacity of the thus-manufactured shopping bags depends on the exact correlation of the handle hole to the welded areas of the welded-on, folded-over wave crests.

The production safety of the machine is ensured if the tubular sheet is cut open by the cutter at any time in order to travel, in the cut-open condition, through the subsequently arranged parts of the installation. In case the tubular sheet is not cut at all, or is not cut open entirely by the cutter, the provision is made according to this invention that an emergency switch to turn off the machine is provided between the cutter for separating the tubular sheet and the first rerouting device; this emergency switch is activated in dependence on the occurrence of uncut tubular sheet.

In this way, sheet that has not been cut open is prevented from clogging the subsequent parts of the machine and the entire installation. The emergency switch can be controlled, for example, by mechanical scanning or by means of a photocell.

The continuous, sinusoidal cutting apart of the tubular sheet is achieved by means of a device wherein the blade of the cutter is equipped with a first motor regulating the rotary movement of the blade and wherein the blade with the first motor is seated on a guide beam arranged transversely to the feeding direction and can be reciprocated together with a second motor transversely to the feeding direction. The sinus cut can be freely adjusted with this device in amplitude as well as in wavelength.

The invention will be described by way of example hereinbelow. In the drawings, representing schematic views:

FIG. 3 shows a tubular sheet with strips thickened by extrusion,

FIGS. 6 and 7 show shopping bags with lateral interconnecting sections,

Figure 1:
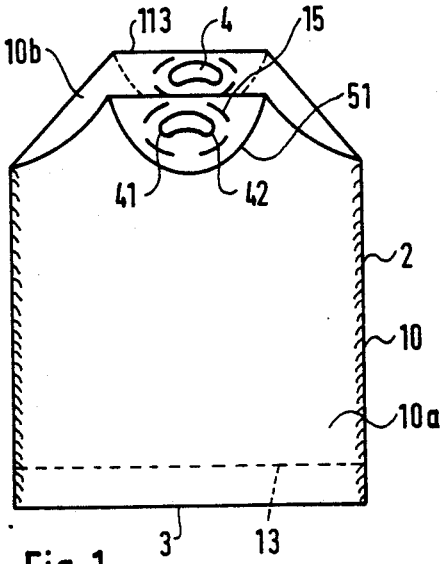
FIGS. 1 and 2 show two different shopping bags in a plan view.
Figure 2:
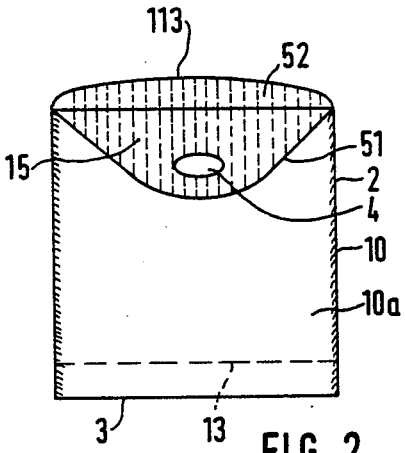
Figure 4:
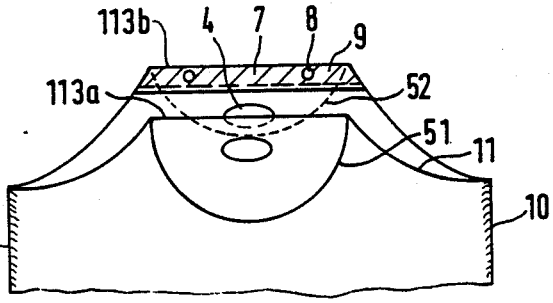
Figure 8:
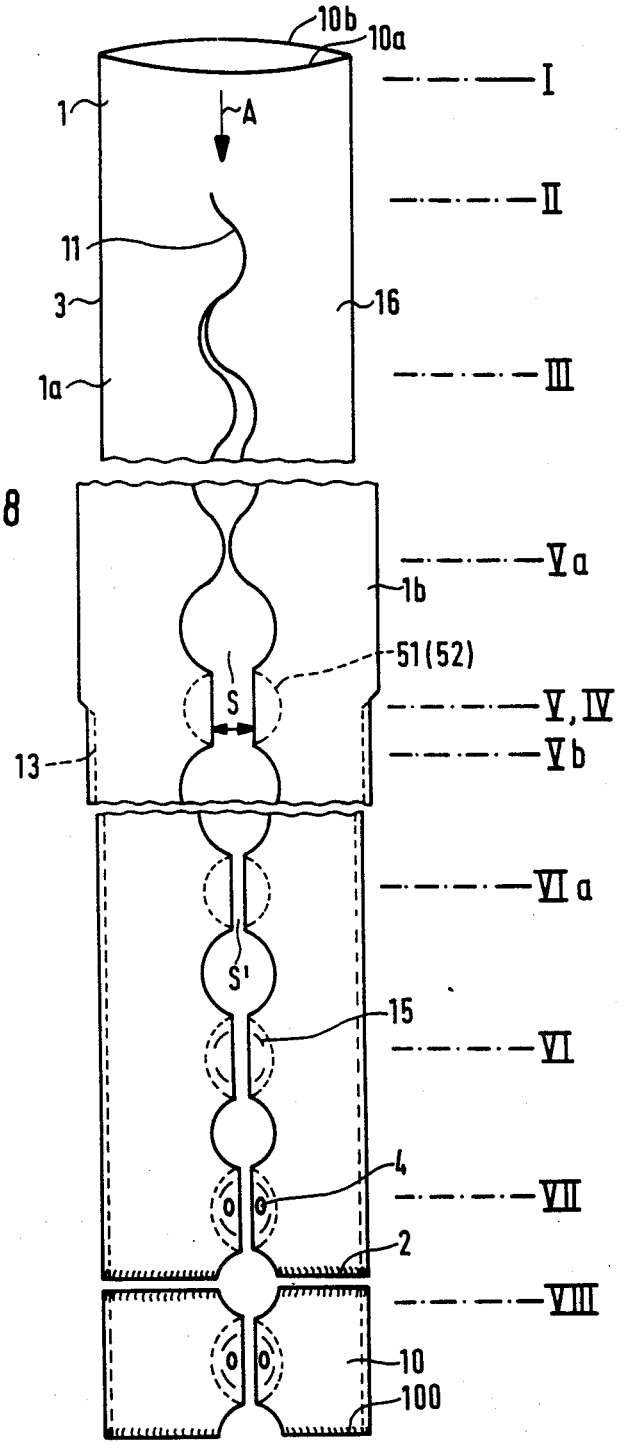
Figure 10:
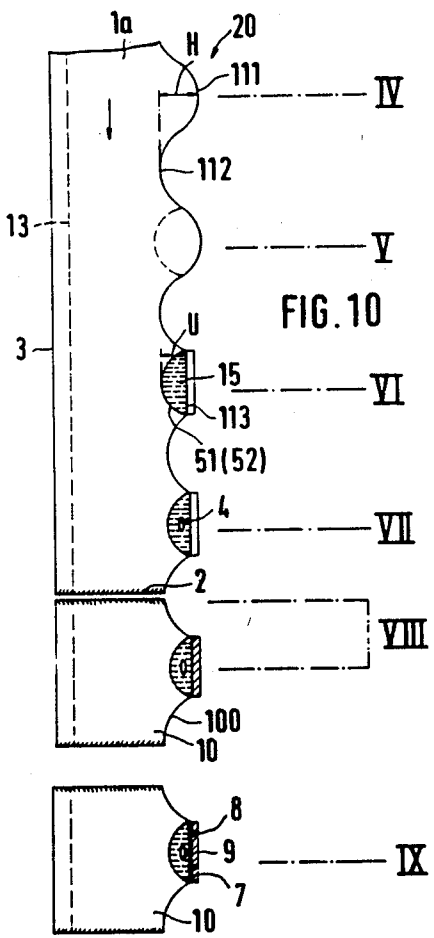
Figure 9:
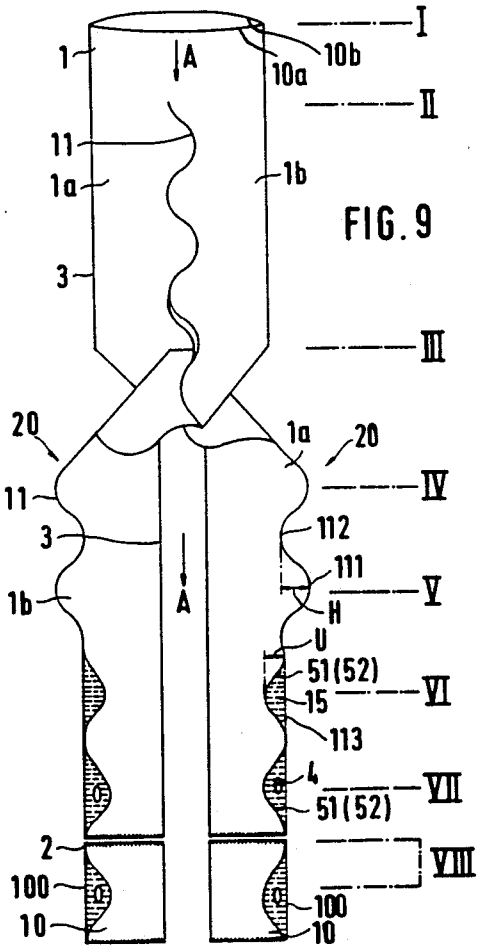
Figure 11:
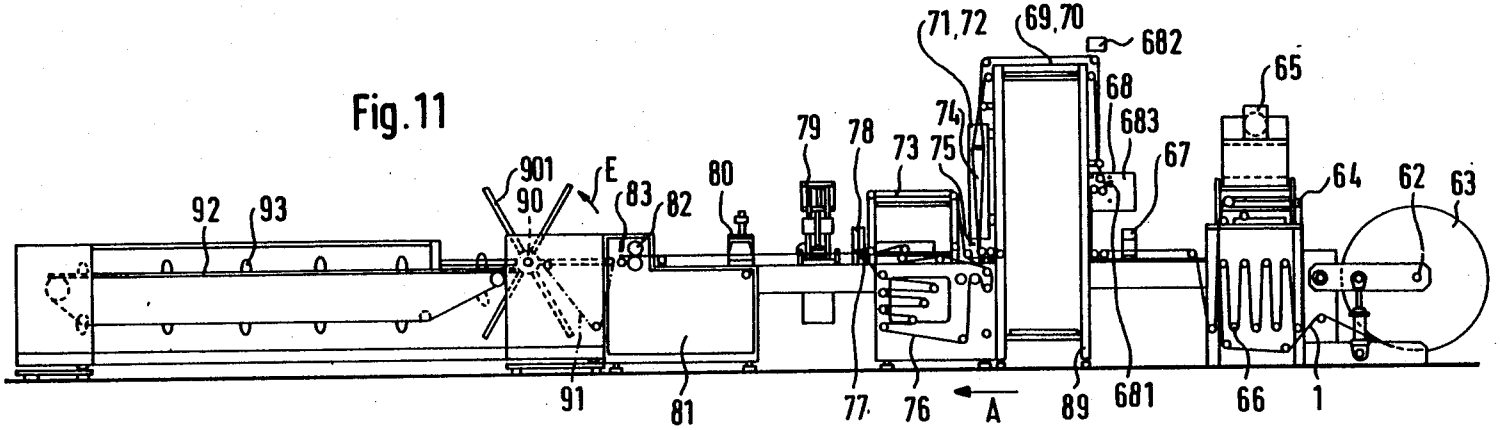
Figure 12:
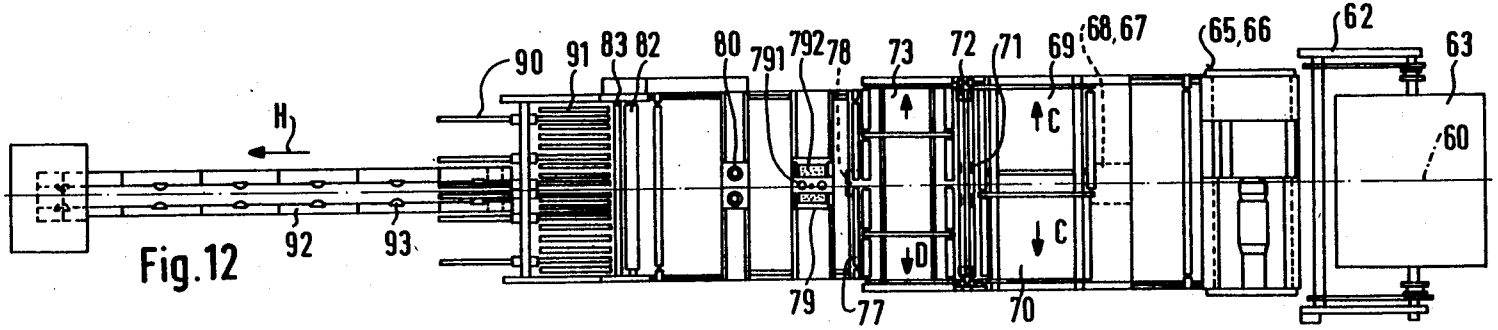
Figure 13:
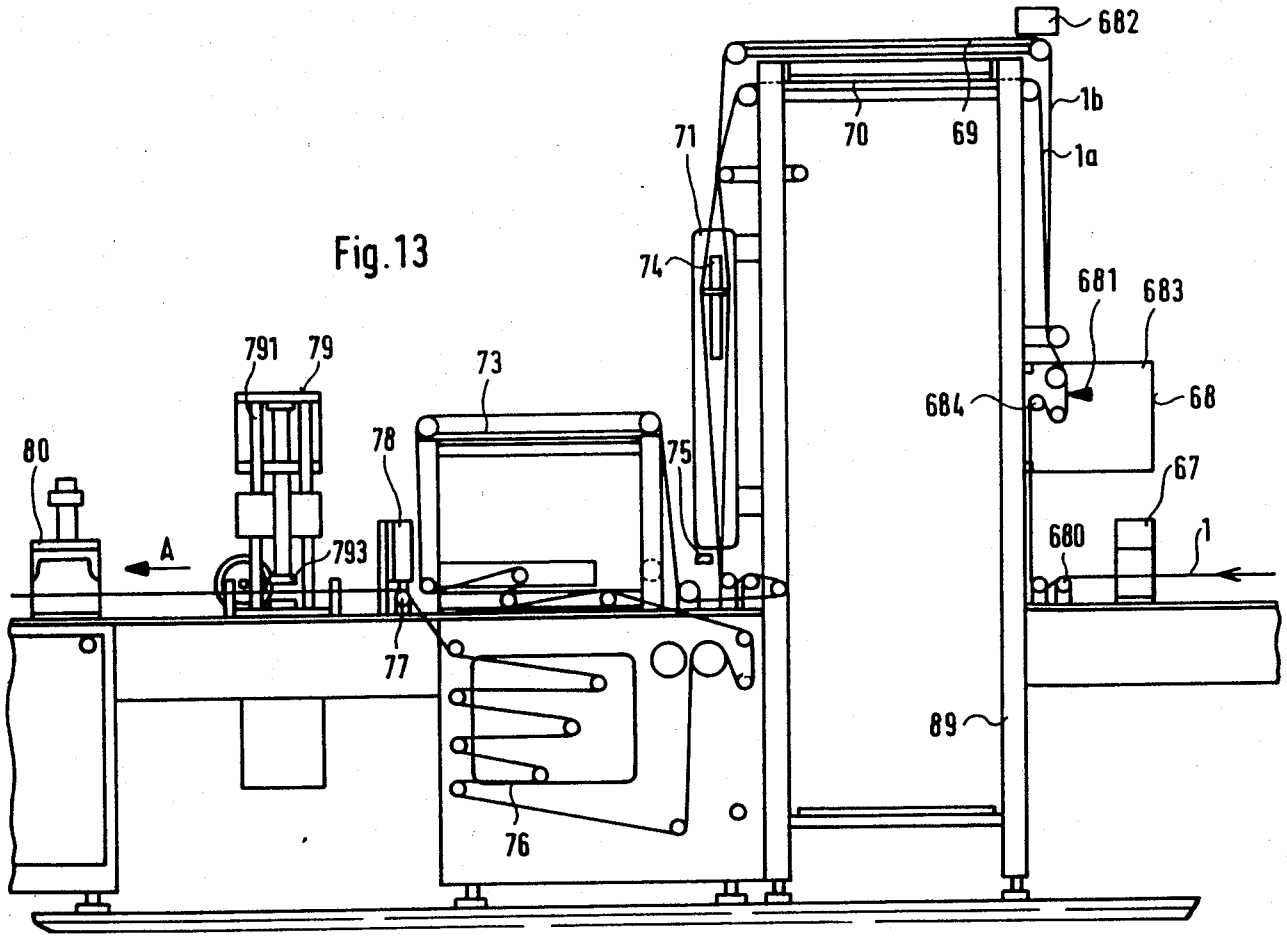

FIG. 8 shows the course of the procedure for the paired manufacture of shopping bags according to FIG. 1, FIG. 9 shows another course of the procedure for the paired manufacture of shopping bags according to FIG. 2, FIG. 10 shows the process sequence for the paired manufacture of shopping bags having interconnecting sections according to FIG. 4, FIG. 11 is a lateral view of an embodiment of the machine, FIG. 12 is a top view of the machine according to FIG. 11 without a tubular sheet, FIG. 13 shows a detail from the lateral view according to FIG. 11.

FIGS. 1 through 7 show various carry bags 10 producible according to the invention and equipped with approximately sinusoidal load-bearing rims, comprising side seams 2 and handle openings 4 reinforced by the flaps 51, 52, with a bottom folding edge 3 and a selectively included bottom pleat 13. The handle openings can exhibit arbitrary shapes.

The two sheet plies 10*a*, 10*b* of the tubular sheet made of a thermoplastic synthetic resin, see FIGS. 8–10, constitute the front wall 10*a* and the rear wall 10*b* of the bag. Alongside the bag aperture, the wave crests are folded over toward the outside or inside entirely, see FIG. 2, or partially, and form the forward and rearward flaps 51, 52. The flaps are welded to the bag walls 10*a*, 10*b* at least in partial zones, see the dashed-line areas 15. Welding can take place according to a pattern with spot weld areas, for example as a grid. The welded areas 15 can extend over the entire flap, see, for example, FIG. 2, or also can be limited to merely the direct zone surrounding the handle hole; see, for example, FIG. 1. According to FIG. 1, the handle hole 4 is surrounded by weld beads 15 in a crescent shape at a small spacing from the hole; these weld beads show a slightly concave curvature with respect to the handle hole. The welded areas 15 in the shape of the weld beads encompass at least the lower corners of the handle hole where the highest stresses occur during carrying. This design of the welding zones is economical and, at the same time, brings about a high resistance against tearing out.

For producing shopping bags having a load-bearing rim thickened by extrusion, a tubular sheet 1 is employed according to FIG. 3 wherein the sinusoidal opening cut 11 is executed preferably within the thickened strips 16 running in the longitudinal extension of the tubular sheet 1. In this way, wave crests are formed made of thickened sheet, which substantially increase, as welded-on flaps, the load bearing capacity of the bags and the tear resistance of the handle openings. The reinforcement provided by the extrusion-thickened strip extends, in case of an entirely folded-over wave crest as well as in case of an only partially folded-over wave crest, up to the lateral seams.

Figure 5:
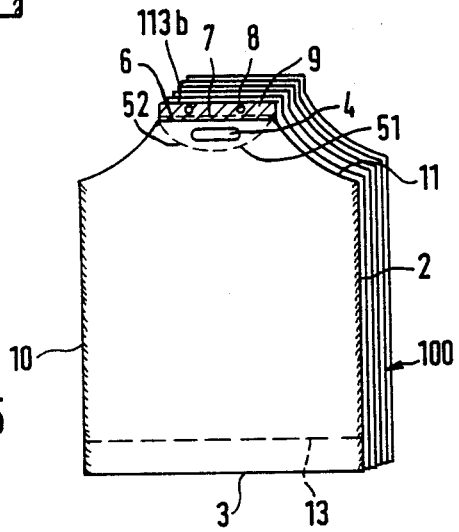
FIGS. 4 and 5 show plan views of interconnected shopping bags.

FIGS. 4 and 5 illustrate interlocked packs 100 of bags 10 with an interconnecting section 9 formed centrally above the handle hole 4, with suspension holes 8 within the interconnecting section, and with the tear-off perforation row 7. According to FIG. 4, the interconnecting sections 9 are formed at the rear wall 10*b* of the bag 10 by folding over the rearward flap 52 with a lesser height than the forward flap 51, so that the flap 52 of the rear wall 10*b* protrudes with its folded-over edge 113*b* beyond the folded-over edge 113*a* of the flap 51 of the front wall 10*a*, thus constituting a marginal strip 9 serving as the interconnecting section 9.

It is also possible, with flaps 51, 52 of equal size, to produce a central interconnecting section 9 on the rear wall 10*b* if, as shown in FIG. 5, a cutout is made from the front wall 10*a* along the edge 6. The tear perforation row 7 extends directly along this cutting edge in the rear wall 10*b*.

FIGS. 6 and 7 show bags 10 with two interconnecting sections 9 on both sides of the handle hole 4. The flaps 51, 52 comprise only a portion of the wave crests. The interconnecting sections are located at the ends of the folding edges 113. In FIG. 6, the interconnecting sections 9 are constituted by both bag walls and marked by arcuate tear-off perforation rows 7. In each interconnecting section 9, a hanging hole 8 is provided. In the embodiment according to FIG. 7, the cutouts 6 with arcuate edges 61 are formed at the ends of the folding edges 113 on the front face of the bag, these cutouts revealing the interconnecting sections 9 on the rear wall. In parallel to the edge 61, the rows 7 of perforations are provided in the rear wall, along which the bags 10 are separated from the pack and from the interconnecting sections 9.

FIG. 8 shows schematically the course of the procedure for manufacturing shopping bags 10 having a folded-over flap, for example according to FIG. 1. For producing two shopping bags in parallel side-by-side relationship, the starting material is a correspondingly wide, laid-flat tubular film 1. The sheet of tubular film 1, fed continuously in the advancing direction A by way of station I, is cut open in the center in sinus form at station II. By virtue of the sinusoidal separating cut 11, the semitubular sheets 1*a*, 1*b* are produced which are pulled apart at least partially in the subsequent station III. In this process, the semitubular sheets 1*a*, 1*b* can already be mutually offset to such a degree that the wave crests and wave troughs run in synchronism. In the subsequent station V, the wave crests 51, 52 of the upper and lower sheet plies 10*a*, 10*b* of the half tubes 1*a*, 1*b* are folded over individually either inwardly or outwardly at least in part, to form flaps 51, 52. At the same time, bottom pleats 13 can be included along the outer folding edges 3 of the semitubular sheets. For this purpose, the bottom pleat applicator station IV is provided which is arranged in parallel to the folding device. Before the folding step is started, the wave crests are electrically discharged in station Va and, after termination of the folding step, again electrically charged in station Vb. Thereafter, the semitubular sheets are reunited in station VIa in order to at least partially compensate for the large gap S in the middle of the conveying route, produced by the folding over of the wave crests in station V, and to reduce this gap to a gap S'. Furthermore, the semitubular sheets, while traveling through station VIa, are mutually shifted to achieve the same level for the wave crests; consequently, the sheets continue their travel in synchronism from this point on, at the latest. Thus far, feeding of the tubular sheets takes place continuously. The subsequent welding on of the flaps to the sheet plies, the punching of the handle hole, and the hot wire welding for producing the side seams and separating of the carry bags take place intermittently in a cycle, respectively after a stepwise advance by one shopping bag width during the standstill of the semitubular sheets. First of all, in station VI, the flaps 51, 52, folded over outwardly or inwardly, are welded to the upper and, respectively, lower sheet plies of the half tubes; in this connection, the welded surfaces 15 can form grids, stripes, bead lines, or the like. In the subsequent station VII, the handle holes 4 are punched; in the next station VIII, the side seams 2 are produced by hot wire welding, and the severed shopping bags 10 are fed to a subsequently arranged conveying means for being collected into packs 100.

In the exemplary course of the process according to FIG. 9, the sinusoidally cut-apart semitubular sheets 1*a*, 1*b* are pulled apart in station III and rerouted by way of two folding stations III so that the semitubular sheet 1*a* previously traveling on the right-hand side then continues its travel on the left-hand side, and the semitubular sheet 1*b*, previously on the left, continues its travel on the right. Thereby, the cutting edges 11 are guided to the outer sides 20 of the conveying route and are easily accessible for processing and manipulation.

Further processing can take place as described in connection with FIG. 8, but the second device VIa for rerouting is omitted.

Insofar as bags according to FIG. 4 are to be manufactured, the procedure is utilized as illustrated, for example, in FIG. 10 schematically in an excerpt. In station V, the wave crests 51, 52 of the upper and lower sheet plies are folded over to a varying level U so that the folding edge 113*b* of the bottom sheet ply 10*b* projects beyond the folding edge 113*a* of the top sheet ply 10*a*. Then the thus-formed flaps 51, 52 are welded to the sheet plies in station VI. In station VII, only the handle hole 4 is punched out. This station is followed by station VIII which is the cutoff welding station, combined, for example, with an interconnecting device. Still during the welding of the side seam 2, the bag 10 lying on the very top of pack 100 is interconnected in the protruding marginal strip 9, i.e. while the bag is still held in an exact position by the welding beams.

For the formation of bags having one or two interconnecting sections 9, for example according to FIGS. 5 and 7, the sections to be cut out from the top sheet ply 10*a* of the half tubes for the interconnecting section to be produced on the bottom sheet ply are punched out in a process according to FIG. 8 after or before the punching of the handle holes 4 in station VII. At the same time, or in a subsequent station, but upstream of the hot wire welding station, a toolholding traverse can be arranged with punching units for the row of perforations extending on the bottom sheet ply and defining the interconnecting section, and optionally for the hanging holes. The punching units mounted onto the toolholding traverses are exchangeable and adjustable and therefore adaptable to differing bag shapes. In the bag according to FIG. 6, punching out of sections from a sheet ply is eliminated.

It is also possible to provide, downstream of the hot wire welding station VIII, a punching station for the bags collected into packs and optionally interconnected; in this punching station, at least the hanging holes are punched in the interconnecting areas and, if desired, the tear-off perforation row is punched out as well.

The machine for producing the shopping bags in accordance with FIGS. 11, 12 and, as a fragmentary view, shown in FIG. 13, comprises the roller 63, rotatably supported in the unwinding stand 62, with the tubular sheet 1 of a thermoplastic synthetic resin. The tubular sheet 1 is conducted in the feeding direction A along the central axis 60 over the take-off device 64 with dancer rolls 66 and is taken off continuously with positional control from the roller 63 by means of a sheet control unit 65 scanning the outer edges of the tubular sheet. The unwinding pedestal is equipped with an electrically or pneumatically operating brake means. The machine comprises a pedestal not denoted in detail to which are mounted, in succession in the feeding direction, the various processing units either in the middle or along the outer sides of the conveying route. The tubular sheet, after controlled takeoff from the unwinding stand, is fed to the cutter 68 for the wave-like, especially sinusoidal cutting open into two semitubular sheets. The cutter 68 has a guide beam 683 arranged in the horizontal position at a vertical pedestal 89 so that the tubular film to be cut open is guided vertically past the cutter from the bottom toward the top. The rerouting of the tubular sheet 1 from the horizontal position takes place by way of one or two rolls 680 into the vertical, the tubular sheet being conducted past the cutter over the pedestal 89 and down again at the opposite side of the latter. In order to obtain an accurate and adequately smooth and tensioned tubular sheet for cutting purposes, respectively two guide rollers 684 are provided upstream of the cutting blade 681 and downstream thereof. The cutter 68 contains the blade 681, the transverse movement of the latter on the guide beam 683 being controlled by a first motor. The blade is additionally equipped with a second motor which is reciprocated on the guide beam together with the blade and regulates the rotary movement of the blade. It is possible in this way to execute the repeating wavy or sinusoidal separating cutting curves continuously and change same in their longitudinal and transverse dimensions in a simple way for adapting them to varying cutting curves and bag dimensions. Upstream of the cutter 68, the scanning head 67 is arranged for controlling the tubular sheet. In case the tubular sheet 1 by accident is not cut open while being guided past the cutter 68, the emergency switch 682 follows the cutter at the pedestal 89; this switch scans the tubular sheets mechanically or by means of a light barrier or a photocell or the like and, when determining that the tubular sheet 1 has not been cut, cuts off the machine. From the cutter 68, the cut-open semitubular sheets 1*a*, 1*b* are guided upwards over the pedestal 89; over rollers on the other side of the pedestal, the sheets are again guided downwards. These roller guides on the topside of the pedestal are simultaneously designed as rerouting means 69, 70 for the two semitubular sheets and are arranged so that the semitubular sheets are pulled apart with the formation of a central gap. The rerouting means are located at differing levels with respect to the pedestal 89 whereby differing path lengths result for the two semitubular sheets. This has the consequence that the semitubular sheets, on the one hand, are guided apart in the direction of arrow C and simultaneously are shifted mutually in the feeding direction A. In order to permit the subsequent, paired welding and punching of the semitubular sheets in the same cycle, the wave crests and wave troughs produced during the cutting step must be conducted head on head in synchronism. The required shift by half a wavelength of the semitubular sheets with respect to each other can take place either completely as early as in the first rerouting device 69, 70 after cutting of the tubular sheet, or alternatively in two stages. In this connection, the first partial shifting is likewise effected by means of the rerouting device 69, 70, and the second partial shifting up to synchronization of the travel of the semitubular sheets takes place after the folding over of the wave crests in the folding device with the aid of a second rerouting means. This stepwise displacement in two steps with intermediately performed folding of the wave crests has the advantage that the expansion distances in the direction of arrow C, i.e. transversely to the feeding direction A, can be kept smaller and thus also a smaller distance is left to overcome during the uniting of the semitubular sheets in the center after folding of the wave crests.

In the region of the vertical route extended downwards at the pedestal 89, the folding device 71 is provided with four rerouting fingers and deflector plates located respectively in pairs on both sides of the longitudinal machine axis 60. At this point, the wave crests of the sheet ply are folded over in each case individually by the desired amount in the inward or outward direction, depending on the arrangement of the rerouting device 71. Directly prior to beginning the folding step, i.e. upstream of the rerouting device 71, the electrical discharge device 74 is provided in the form of rods guided between sheet plies in the region of the passing-through wave crests. At the outlet of the folding device 71, the electrostatic charging device 75 is arranged in the shape of a charging rod arranged transversely to the feeding direction. The rod can be partially shielded in the zones where no charging is to take place. In parallel to the folding device 71, supporting units 72 are provided on the outsides of the machine for supporting the outwardly traveling edges of the semitubular sheets. These supporting units can simultaneously be designed as a device for the production of bottom pleats. Downstream of the charging device, a further path rerouting device 73 is provided. This rerouting device 73 comprises roller guide means for each semitubular sheet, making it possible to reunite the semitubular sheets in the direction of arrow D in the center up to a desired gap S'. Furthermore, the displacement of the semitubular sheets in the feeding direction with respect to each other can take place by differing path lengths. The compensating device 76 is arranged thereafter. The compensating device 76 is the buffer for the semitubular sheets between the continuous feeding while being taken off the unwinding pedestal and the intermittent, sectional feed for the welding, punching, etc. Such a compensating device, operating, for example, with loops and regulating the intermittent advance of the sheet is described, for example, in DOS 2,514,600. In the feeding direction, the compensating device 76 is followed by the intermittently operating devices of the machine, such as the contact welding device 79 for welding the folded-over wave crests as flaps to the sheet layer, the punching unit 80 for punching the handle holes, and the cross cutting and welding unit 83. The desired positions for the handle hole, the association of the welded surfaces of the flaps, the lateral weld seams of the bags, must be maintained with maximum accuracy. In order to make this possible, a control unit is arranged upstream of the contact welding unit 79. The control device comprises the scanning head 78 which scans either the inner or outer edges of the two semitubular sheets, in the illustrated example the inner edges. The correction of the position of the semitubular sheets is effected by means of two correction rolls 77 arranged side-by-side transversely to the feeding direction; these rolls are located underneath the scanning heads, and the semitubular sheets are guided over these rolls. The adjustment and/or correction of the position of the semitubular sheets for entrance into the subsequent devices is performed by lifting and, respectively, lowering of the correction rolls 77, which latter are individually controllable. The intermittent feed of the semitubular sheets is executed by the intermittently operating sheet feeding unit 81 with the pair of feeding rollers 82 arranged directly upstream of the cross cutting and welding device 83. During the standstill of the semitubular sheets, the contact welding unit 79, the punch 80, and the welding bars of the unit 83 are operated. The punching means 80 and the contact welding unit 79 are arranged centrally along the middle axis and equipped with the corresponding tool parts for the paired manufacture of shopping bags and processing of the two semitubular sheets. The contact welding unit 79 exhibits the pedestal 791 which is arranged in the central axis 60 of the machine in the free space between the semitubular sheets. The backup plates 792 which engage toward both sides in between the sheet layers of the semitubular sheets are attached to the pedestal. Below and, respectively, above the semitubular sheets, the welding dies 793, four in total, are mounted; these dies can be moved up and down along the pedestal. The welding dies are designed of a configuration corresponding to the desired welding surfaces for the welding of the wave crests. The control device 79 also serves for the correct association of the handle holes to be punched out with respect to the welding areas with which the wave crests are welded to the sheets and which surround the handle hole.

The shopping bags, severed in pairs by the cross cutting and welding unit 83, are subsequently deposited on a depositing grate or on revolving belts 91 and seized by the gripper arms 901 of the rotating conveying means 90 in the direction of arrow E and, after being pivoted by 180°, deposited at a collecting point. The collecting point can consist, for example, of two chain conveyors 92 arranged in parallel side-by-side and being each equipped with a revolving chain with upwardly extending pins 93. Respectively on the pin located closest to the conveying device 90, a pack of shopping bags is gathered and, after attaining a predetermined number, the chain is moved further by an increment corresponding at least to one bag width, in the direction of arrow H. The collected packs are then taken off the chain conveyor 92 and packaged, for example, into cartons. The two chain conveyors 92 can be adjusted in their mutual distance. They can be equipped either with a drive means common to both of them, optionally with respectively separate control, or also each with its own drive mechanism. The drive means for the chain conveyors can be regulated, for example, by way of a counter unit coupled with the conveying means.

It is also possible to arrange other depositing and conveying systems downstream of the cross cutting and welding device 83. For example, the depositing and conveying devices can exhibit stacking plates with one or several upwardly projecting pins on which the carry bags are collected into packs and interconnected by means of an associated interconnecting device and/or perforated. Also the hanging holes can be punched out at this point. A perforating punching device for marking tear-off lines can be located, for example, also upstream or downstream of the punching means 80 in the machine.

In order to produce interconnected shopping bags in accordance with FIG. 5 or FIG. 7, a section must be removed by punching from the top sheet ply, uncovering the interconnecting section 9 on the bottom sheet ply. This punching step can take place advantageously after the welding on of the folded-over wave crests in the contact welding unit 79 and before punching of the handle holes by means of the punch 80, or it can take place thereafter in an additional punching device not illustrated in detail. Also this punching device is to be located in the central axis 60 of the machine and exhibits, at a pedestal, a backup plate engaging in between the two sheet plies of the semitubular sheets. In this case, liftable and lowerable punching blades are attached to the pedestal above the semitubular sheets.

In FIG. 13, the area of the machine from the cutter 68 up to the punch 80 for the handle holes according to FIG. 11 is shown on an enlarged scale. This provides a clearer illustration of the guidance of the tubular sheet 1 and, respectively, the semitubular sheets over rollers 680, 684, and clarifies the individual processing stations.

We claim:

1. A machine for the paired manufacture of carry bags with a punched-in handle opening, a reinforcing sheet surrounding the handle opening, and lateral weld seams, from a laid-flat tubular sheet of synthetic resin sheeting, comprising, in succession in a feeding direction, a first continuously operating take-off device for the tubular sheet, equipped with a sheet edge control, a continuously operating cutter for separating the tubular sheet with a wave-like extending severing cut into two semitubular sheets having wave crests and wave troughs along the severing cut, a rerouting device for moving the semitubular sheets apart transversely to the feeding direction and for partial offsetting of the semitubular sheets with respect to each other in parallel to the feeding direction, a second intermittently operating take-off device for the stepwise advancement of the semitubular sheets, wherein a compensating device for the sheet feed is provided between the first and second take-off devices, and a punching unit for the handle opening operable periodically during the standstill of the semitubular sheets, a cross cutting and welding device for the welding together and severing of the carry bags, as well as a conveying device for depositing the carry bags, characterized in that there is provided, following the rerouting device, a folding device with rerouting fingers and deflector plates arranged in pairs on both sides of a longitudinal machine axis for folding over of mutually opposed wave crests of upper and lower sheet plies of the semitubular sheets onto the sheet plies with continuous sheet feed, and respectively one supporting device is arranged in parallel to the folding device at the outer edges of the semitubular sheets; that, directly upstream of the folding device, an electrical discharge device for neutralizing charges on the plies is arranged and, directly upstream of the folding device, an electrical charging device for applying charges to the plies is provided; that, downstream of the compensating device following the folding device a control unit is provided with scanning heat and a correction roll for each semitubular sheet, which scans inner or outer edges for the positionally accurate locating of the semitubular sheets with respect to the subsequently arranged, intermittently operable processing stations; and that there is provided, upstream of the punching unit, a contact welding device with a pedestal in the longitudinal machine axis with a backup plate guided between the sheet plies and with liftable and lowerable welding plates acting from the top and from the bottom on the sheet plies from the outside.

2. A machine according to claim 1, characterized in that two elongated rods are provided, as the discharge unit, in parallel to the feeding direction between the two sheet plies of each semitubular sheet and a rod is provided, as the charging device, acting transversely to the feeding direction from the outside on the semitubular sheets and having inactive zones which are shielded.

3. A machine according to claim 1 or 2, characterized in that the semitubular sheets are guided vertically from top towards bottom on the pedestal while passing the folding device.

4. A machine according to claim 1, characterized in that there is arranged, between the folding device and the compensating device, a further sheet rerouting device for uniting the semitubular sheets transversely to the feeding direction and/or for shifting the semitubular sheets with respect to each other in the feeding direction.

5. A machine according to claim 1, characterized in that said cutter comprises a blade and a first motor controlling the rotary movement of the blade, and the blade with the first motor is seated on a guide beam located transversely to the feeding direction; the blade and the first motor being reciprocated transversely to the feeding direction with a second motor.

6. A machine according to claim 1, characterized in that an emergency switch for turning off the machine is provided between the cutter for severing the tubular sheet and the first rerouting device this emergency switch being activated in dependence on the occurrence of uncut tubular sheet.

* * * * *